US007207569B1

(12) United States Patent
Haston

(10) Patent No.: US 7,207,569 B1
(45) Date of Patent: Apr. 24, 2007

(54) INTERACTIVE GAME SYSTEM

(76) Inventor: Lynn Taylor Haston, 2513 Highway 25 South, Greenwood, SC (US) 29646

( * ) Notice: Subject to any disclaimer, the term of this patent is extended or adjusted under 35 U.S.C. 154(b) by 259 days.

(21) Appl. No.: 10/895,684

(22) Filed: Jul. 20, 2004

(51) Int. Cl.
*A63B 67/00* (2006.01)
*A63F 1/04* (2006.01)

(52) U.S. Cl. ..... 273/447; 273/444; 273/292

(58) Field of Classification Search ..... 273/447, 273/445, 440, 302, 308
See application file for complete search history.

(56) References Cited

U.S. PATENT DOCUMENTS

| | | | | |
|---|---|---|---|---|
| 1,745,946 | A | 2/1930 | Murray | |
| 2,284,256 | A * | 5/1942 | Benrath | 273/302 |
| 2,607,595 | A * | 8/1952 | Mathes | 273/302 |
| 4,773,643 | A * | 9/1988 | Mizunuma | 273/445 |
| 4,801,149 | A * | 1/1989 | Alnafissa | 273/302 |
| 4,948,146 | A | 8/1990 | Snyder et al. | 273/273 |
| 5,112,059 | A | 5/1992 | Mundle et al. | 273/292 |
| 5,150,907 | A | 9/1992 | Desmarais et al. | 273/420 |
| 5,180,306 | A | 1/1993 | McInroy et al. | 434/129 |
| 5,186,467 | A | 2/1993 | Chasin | 273/298 |
| 5,467,997 | A * | 11/1995 | Bashirzadeh | 273/302 |
| 5,580,252 | A | 12/1996 | McCrady | 434/128 |
| 5,690,336 | A | 11/1997 | Oliver | 273/302 |
| 6,003,869 | A | 12/1999 | Kuo | 273/292 |
| 6,017,035 | A | 1/2000 | Glasser et al. | 273/308 |
| 6,095,527 | A * | 8/2000 | Robertson | 273/445 |
| 6,142,475 | A | 11/2000 | Hennessey | 273/296 |
| 6,179,294 | B1 | 1/2001 | Turnali | 273/302 |
| 6,267,377 | B1 * | 7/2001 | Griggs | 273/292 |
| 6,296,253 | B1 * | 10/2001 | Waychoff | 273/447 |
| 6,402,152 | B1 | 6/2002 | Kutzik | 273/296 |
| 6,435,508 | B1 | 8/2002 | Tavel | 273/292 |
| 2002/0043764 | A1 | 4/2002 | Imhof | 273/292 |

OTHER PUBLICATIONS

"Pig, Spoons", Sep. 15, 2003. <http://www.pagat.com/passing/pig.html> pp. 1-3.*
Pig, Spoons, Pagat.com, Website Printout, Feb. 15, 2004, 3 pages.
Spoons, Pagat.com, Website Printout, Feb. 15, 2004, 5 Pages.

* cited by examiner

*Primary Examiner*—Eugene Kim
*Assistant Examiner*—Alyssa M. Lowen

(57) ABSTRACT

An interactive game system for providing a spoons related game that promotes education of the United States. The interactive game system includes providing a card deck, a plurality of data cards, a plurality of playing spoons, and a data spoon. The data cards and the data spoon preferably include information regarding a subject such as the United States or a specific state. Based upon the number of players (N) present, N-1 data cards are inserted into the card deck and N-2 playing spoons along with the data spoon are placed in the center of the playing table. Each player is dealt five cards and the dealer then draws a card from the card deck. The dealer then may retain or pass the card to the player to their left. Play is continued until a player has four matching playing cards and a data card in their hand.

15 Claims, 7 Drawing Sheets

INTERACTIVE GAME SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to the game of spoons and more specifically it relates to an interactive game system for providing a spoons related game that promotes education of the United States.

2. Description of the Related Art

Spoons, the game, has been in use for years (sometimes referred to as "pig" or "donkey") and three to eight players may play. The objective of spoons is to get rid of a player's cards before anyone else does. There are different ways to play spoons, but an exemplary set of rules for spoons is located at http://www.pagat.com/eights/spoons.html which is hereby incorporated by reference.

Conventional spoons utilizes a standard 52-card deck (without jokers) and [N-1] spoons where N is the original number of players. The spoons are positioned in the center of the table.

The cards are then dealt to each of the players (e.g. 5 cards per player) with the remaining cards in the deck being placed in the center of the table. The top card of the deck is turned over to begin the discard pile. The first player then must either (1) discard a card from their hand onto the discard pile or (2) draw a card from the deck.

The player may discard a card from their hand only if it matches the current discarded card in either suit or rank (e.g. if the top card is a queen of diamonds, then they may discard either a diamond or a queen). Upon discarding the card, the player must say the name of the card or get "razzed" (a penalty applies if they don't where they have to draw another card).

If the player draws a card and the newly drawn card matches the current discarded card in either suit or rank, they may immediately discard the newly drawn card. If not, then the player must add the newly drawn card to their hand. Play then progresses to the next player. If all of the cards in the deck are drawn, then the discarded cards are shuffled and reused.

When a player is holding only one card, the player typically must say "one card" along with the name of that card or get a penalty. When a player discards their last card, they must announce the name of the card or receive a penalty. When the player discards their last card, they will grab one spoon and then the remaining players attempt to grab a spoon. Because there are N-1 spoons available, one player will be left without a spoon and will no longer be part of the game.

The next round is played with N-2 spoons. Play continues until only one player is left as the winner.

BRIEF SUMMARY OF THE INVENTION

In view of the foregoing disadvantages inherent in the known types of spoons games now present in the prior art, the present invention provides a new interactive game system construction wherein the same can be utilized for providing a spoons related game that promotes education of the United States.

The general purpose of the present invention, which will be described subsequently in greater detail, is to provide a new interactive game system that has many of the advantages of the spoons games mentioned heretofore and many novel features that result in a new interactive game system which is not anticipated, rendered obvious, suggested, or even implied by any of the prior art spoons games, either alone or in any combination thereof.

To attain this, the present invention generally comprises providing a card deck, a plurality of data cards, a plurality of playing spoons, and a data spoon. The data cards and the data spoon preferably include information regarding a subject such as the United States or a specific state. Based upon the number of players (N) present, N-1 data cards are inserted into the card deck and N-2 playing spoons along with the data spoon are placed in the center of the playing table. Each player is dealt five cards and the dealer then draws a card from the card deck. The dealer then may retain or pass the card to the player to their left. Play is continued until a player has four matching playing cards and a data card in their hand.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an interactive game system that will overcome the shortcomings of the prior art devices.

A second object is to provide an interactive game system for providing a spoons related game that promotes education of the United States.

Another object is to provide an interactive game system that may be played by two or more players.

An additional object is to provide an interactive game system that provides a collectible set of cards and spoons which contained data.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
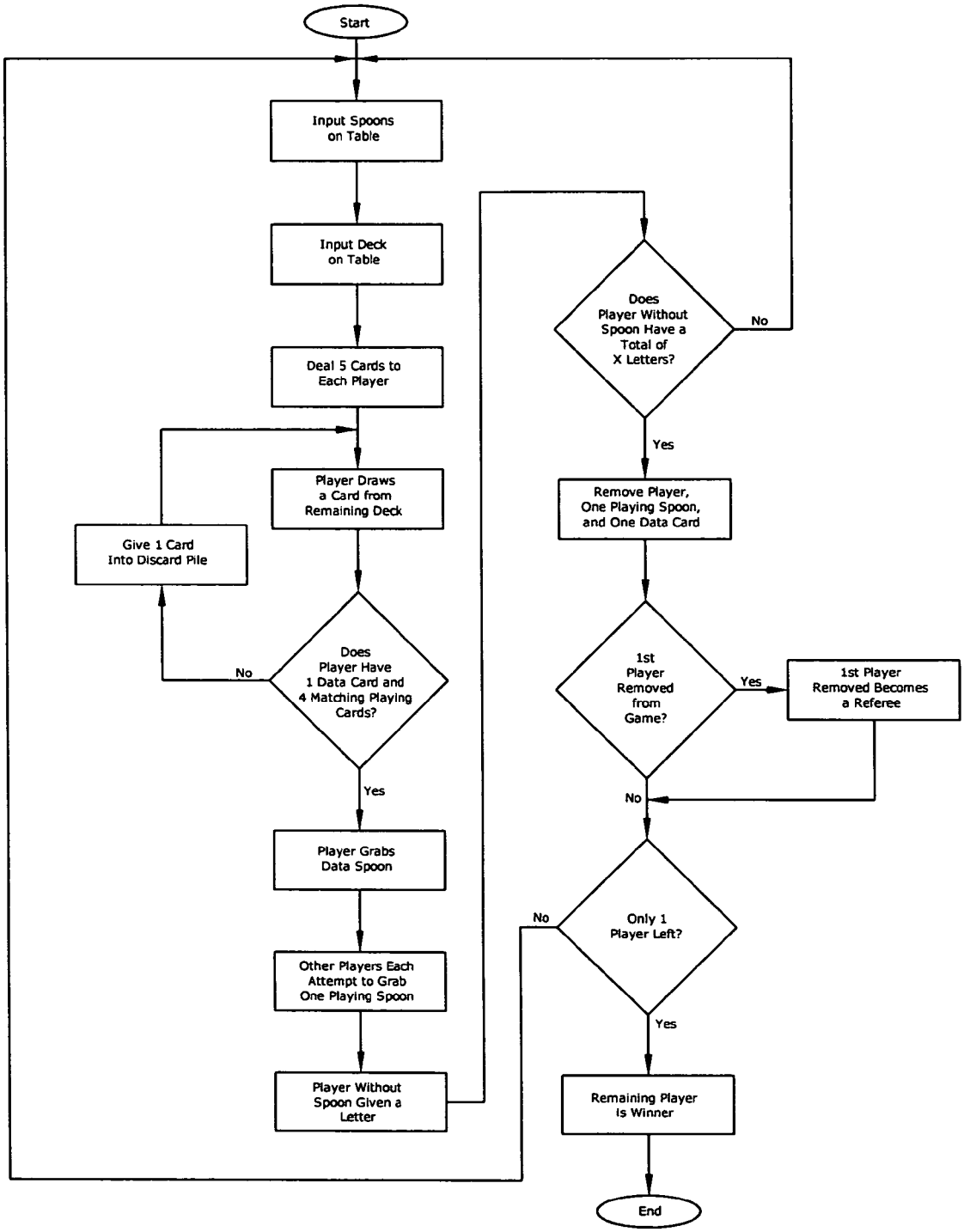
FIG. 1 is a flowchart illustrating the overall operation of the present invention.

Turning now descriptively to the drawings, in which similar reference characters denote similar elements throughout the several views, FIGS. 1 through 7 illustrate an interactive game system, which comprises providing a card deck 20, a plurality of data cards 52, a plurality of playing spoons 40, and a data spoon 30. The data cards 52 and the data spoon 30 preferably include information regarding a subject such as the United States or a specific state. Based upon the number of players (N) present, N-1 data cards 52 are inserted into the card deck 20 and N-2 playing spoons 40 along with the data spoon 30 are placed in the center of the playing table 12. Each player is dealt five cards and the dealer then draws a card from the card deck 20. The dealer then may retain or pass the card to the player to their left. Play is continued until a player has four matching playing cards 50 and a data card 52 in their hand.

B. Card Deck

Figure 5B:
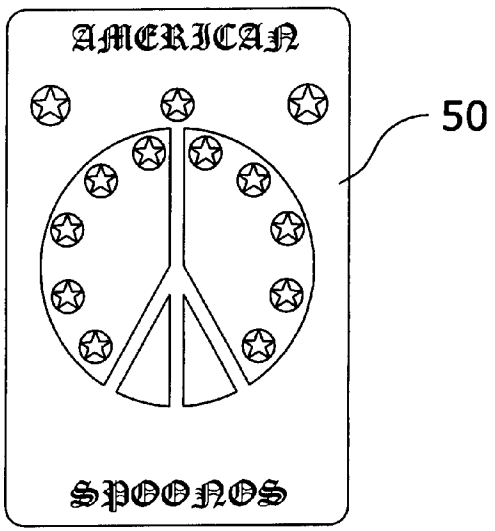
FIG. 5*b* is a top view of another exemplary playing card.
Figure 5C:
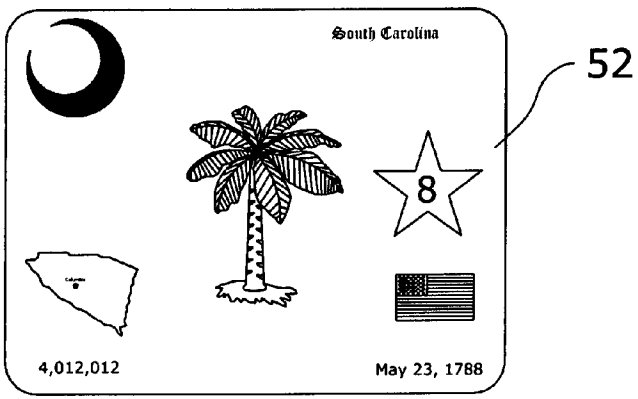
FIG. 5*c* is a top view of an exemplary data card.
Figure 5A:
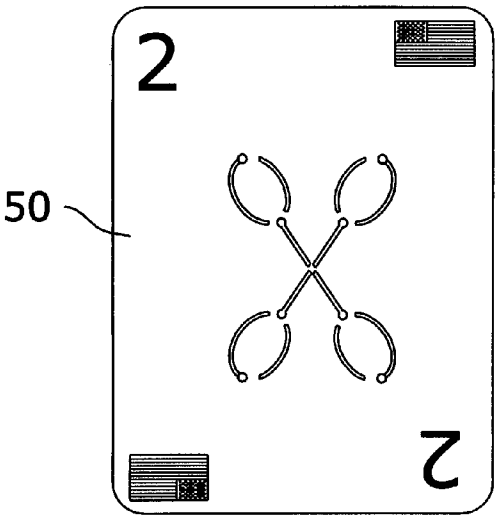
FIG. 5*a* is a top view of an exemplary playing card.

The card deck 20 is comprised of playing cards 50 and at least one data card 52. The playing cards 50 may be comprised of a conventional 52 deck 20 of cards (or multiples of the same). The playing cards 50 may also be comprised of cards specifically designed for the game such as shown in FIGS. 5*a* and 5*b* of the drawings.

The playing cards 50 typically are numbered (e.g. 2–10) and may include additional types of cards (e.g. jacks, queens, kings and aces) along with different "suits" (e.g. hearts, diamonds, spades and clubs) which are well-known in the art of card games. It is preferable not to have any jokers within the card deck 20.

The data cards 52 are comprised of a shape and size similar to the playing cards 50. FIG. 5*c* displays an exemplary data card 52 that may be utilized within the present invention.

The data cards 52 preferably are comprised of information relating to a specific subject/topic (e.g. state, country, sport, etc.). FIG. 5*c* illustrates a data card 52 being comprised of data relating to the State of South Carolina (e.g. population, flag, shape). To further example, there could be 50 data cards 52 in a set wherein each data card 52 represents a specific state in the United States. This data is preferably educational and informative for the reader which helps educate them regarding the specific subject/topic.

The type of subjects/topics that are usable within the present invention for the data cards 52 is virtually unlimited. The data cards 52 may also not illustrate any specific subject/topic and may merely represent that they are different from the playing cards 50.

C. Spoons

The spoons are comprised of one or more playing spoons 40 along with one or more data spoons 30. The playing spoons 40 may be comprised of any conventional spoon which is well known in the game of spoons.

Figure 6:
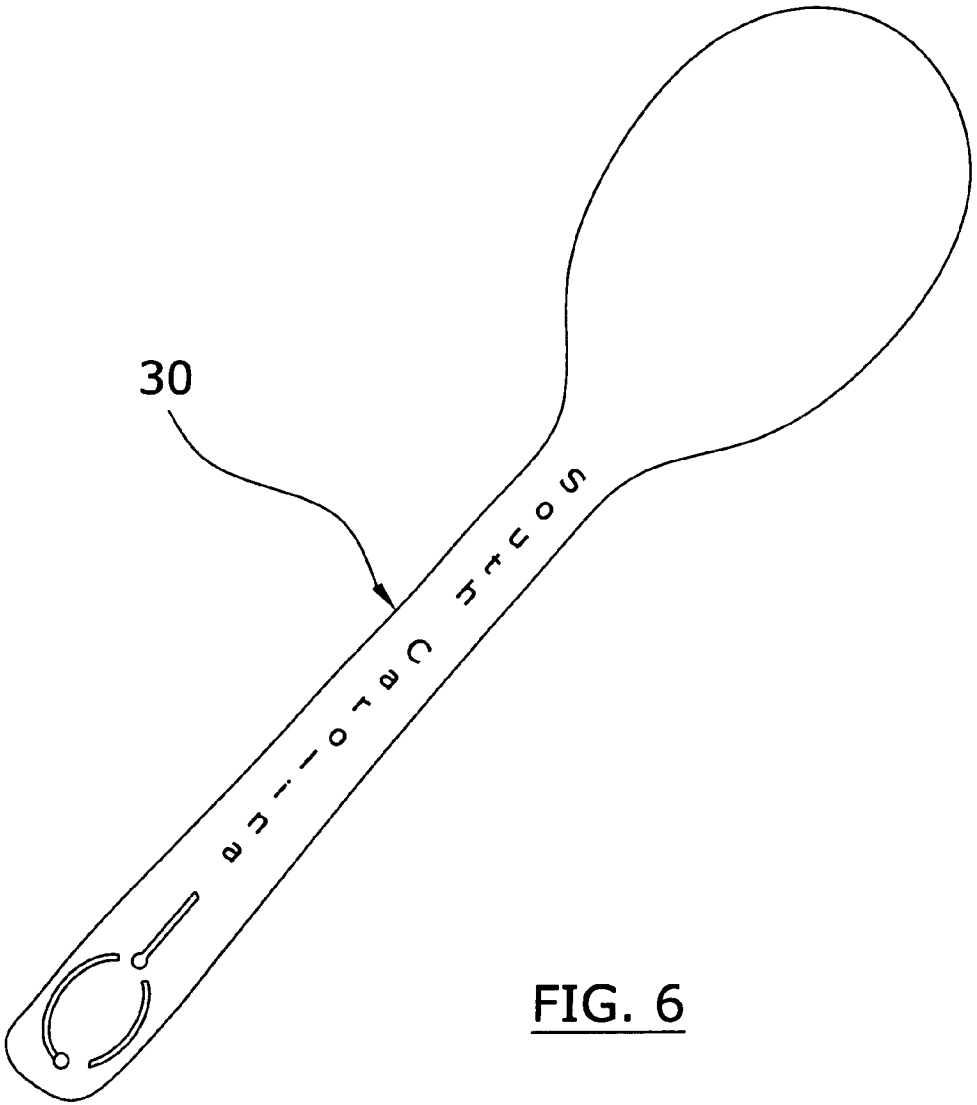
FIG. 6 is a top view of the data spoon.

The data spoon 30 preferably is comprised of information relating to a specific subject/topic (e.g. state, country, sport, etc.) similar to the data cards 52. FIG. 6 illustrates a data spoon 30 with the title of State of South Carolina printed upon the handle of the data spoon 30. To further example, there could be 50 data spoons 30 in a set wherein each data spoon 30 represents a specific state in the United States similar to the data cards 52.

D. Playing Table

Figure 7:
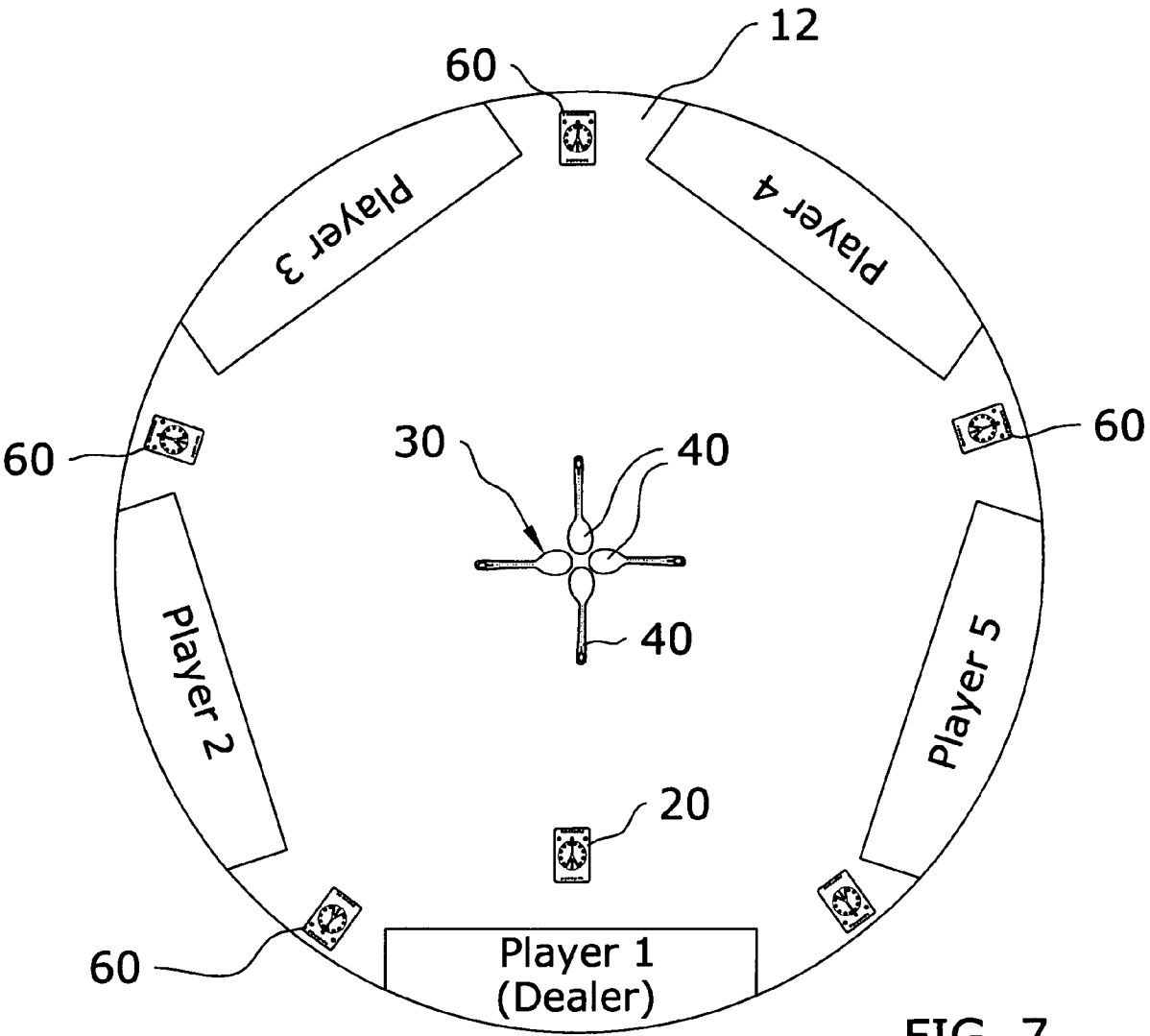
FIG. 7 is a top view of the playing table illustrating the discard piles, the deck, the playing spoons and the data spoon positions.

The playing table 12 may be comprised of any conventional playing surface (e.g. dining room table, card table, dinner table, etc.). The players all surround the table in a respective player position as shown in FIG. 7 of the drawings. Each player has a discard pile 60 to their respective left side (could be right side alternatively) where they will discard cards to. The playing spoons 40 and one data spoon 30 are positioned within the center of the playing table 12 as further illustrated in FIG. 7 of the drawings.

E. Winning Hand

To establish a "winning hand", a player must have one data card 52 and four playing cards 50 of the same value. An example of a winning hand would be a data card 52 of the State of South Carolina along with a 4 of diamonds, a 4 of hearts, a 4 of clubs and a 4 of spades.

If a player has a winning hand, they then grab the data spoon 30 indicating to the other players that they have won. After the winning player has grabbed the data spoon 30, the other players then attempt to grab the remaining playing spoons 40.

Since there are one less playing spoons 40 than remaining players, one of the remaining players will not have a spoon. This player is then given a letter of a word/phrase that is being spelled that has a specific number of letters (e.g. PRIDE). For example, if the word being spelled is PRIDE, the player to lose the first round will be given the letter "P". If the same player loses another round, they will be given the letter "R" and so forth until PRIDE is spelled resulting in the removal from the game.

F. Operation of Invention

Figure 4:
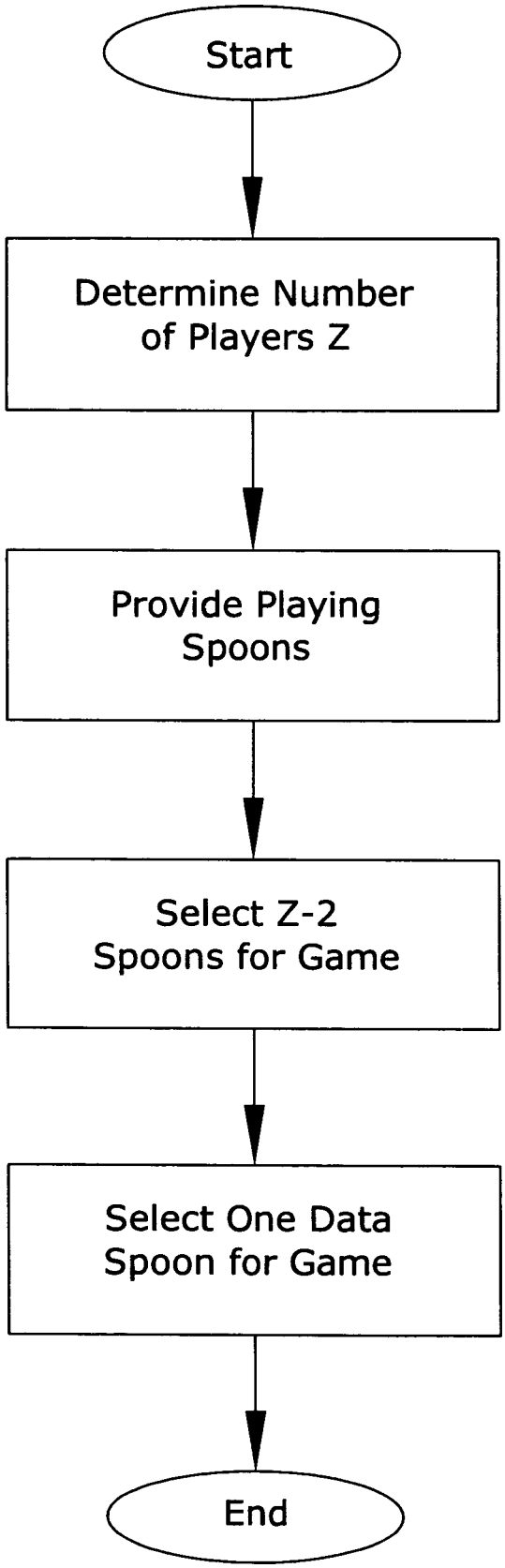
FIG. 4 is a flowchart illustrating the selection of the playing spoons and the data spoon.

As shown in FIG. 1 of the drawings, the playing spoons 40 and the data spoon 30 are placed in the center of the table. The number of playing spoons 40 placed within the playing table 12 is comprised of Z (original number of players) minus two as shown in FIG. 4 of the drawings. For example, if there are five players, three playing spoons 40 (5 minus 2) would be positioned upon the playing table 12 initially along with one data spoon 30 for a total of four spoons.

The card deck 20 is created by inserting Z-1 data cards 52 into the playing cards 50. For example, if there are five players, four data cards 52 are then inserted into the card deck 20 along with the playing cards 50. The cards are then dealt to each of the players by a predefined number of cards per hand (e.g. 5 cards, 6 cards, etc.). After the cards are dealt, the dealer then positions the card deck 20 upon the playing table 12 (preferably next to the dealer).

Figure 2:
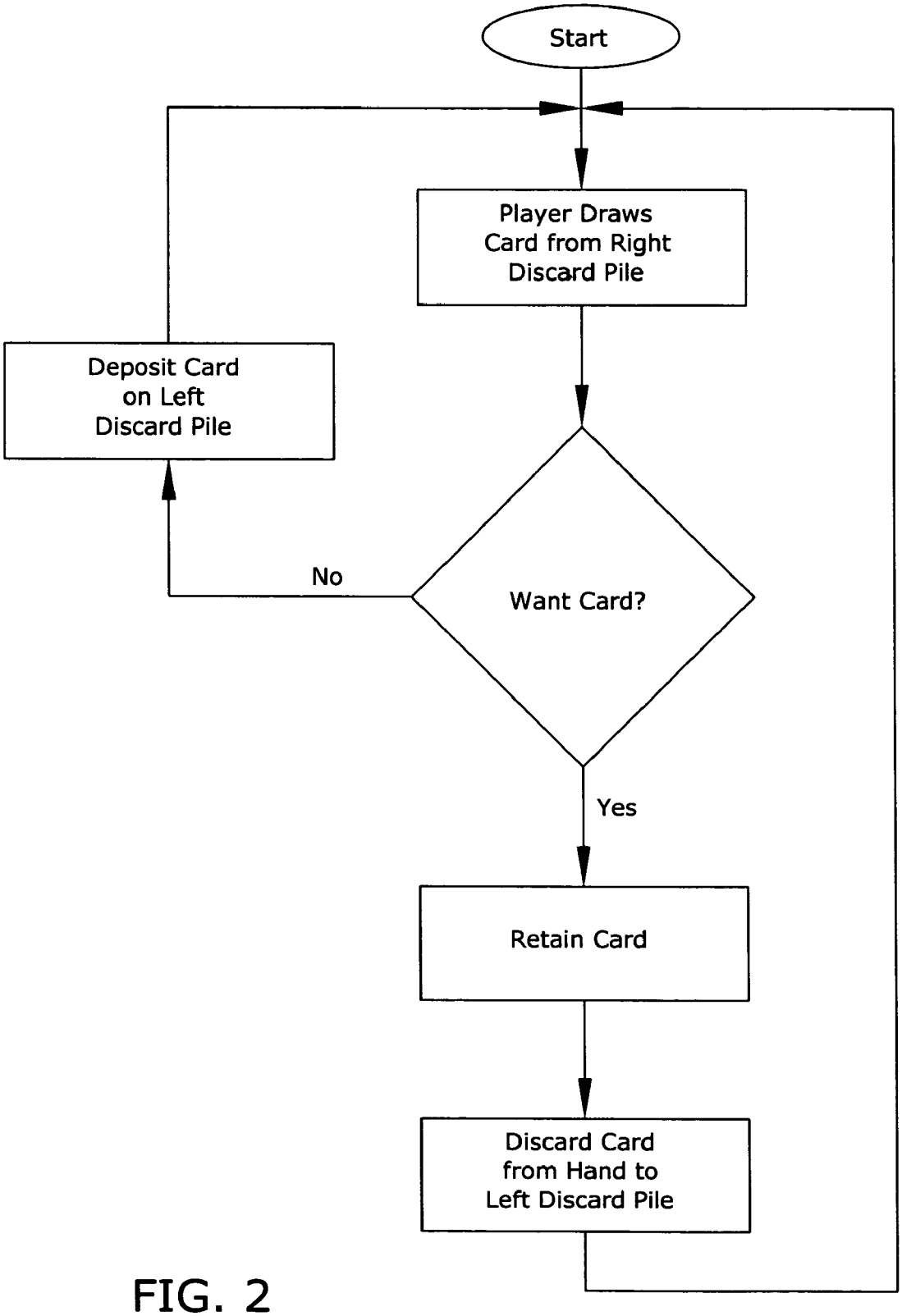
FIG. 2 is a flowchart illustrating the decision process for retaining/discarding cards from a player's hand.
Figure 3:
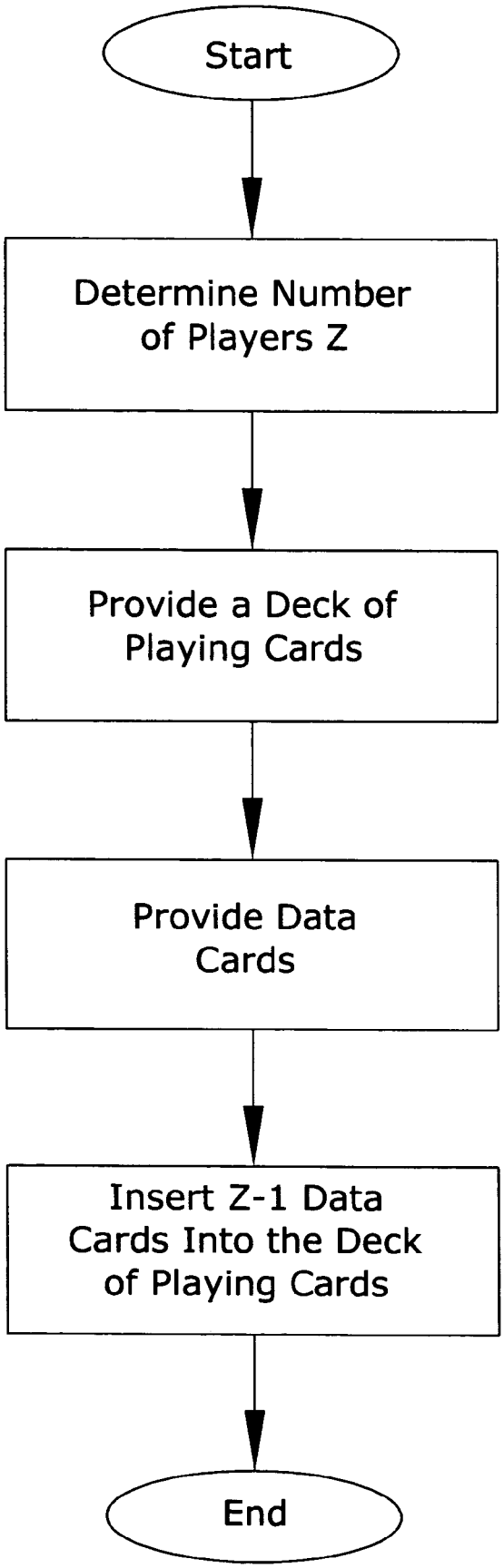
FIG. 3 is a flowchart illustrating the selection of the card deck with the data cards.

After each player is dealt their respective hands and there are no immediate winners, the dealer (e.g. Player 1) draws one card from the card deck 20 as shown in FIGS. 1 and 2 of the drawings. Player 1 then decides whether or not they want to keep the card based upon the cards currently in their hand as shown in FIG. 2 of the drawings. If Player 1 decides to retain the card, Player 1 must then discard another card from their hand since no player can have more than their original number of cards initially dealt. Player 1 may also decide to simply discard the drawn card immediately. The discarded card is placed in the discard pile 60 to the left of Player 1 as shown in FIG. 7 of the drawings. Player 1 is then able to continue with drawing another card from the card deck 20. Player 1 continues with this process until there is a winner.

Moving in a clockwise manner, the player to the left of the dealer (e.g. Player 2) then draws the discarded card from the discard pile 60 to their respective right (or left alternatively if rotating counter-clockwise) provided by the dealer. Player 2 then decides whether or not they want to keep the drawn card based upon the cards currently in their hand as shown in FIG. 2 of the drawings. If Player 2 decides to retain the card, Player 2 must then discard another card from their hand since no player can have more than their original number of cards initially dealt. Player 2 may also decide to simply discard the drawn card immediately. The discarded card is placed in the discard pile 60 to the left of Player 2 as shown in FIG. 7 of the drawings. Player 2 is then able to continue with drawing another card from the discard pile 60 to their right (if a card is present). The player to the right of the dealer (e.g. Player 5), discards their cards in a discard pile 60 that no one draws from (this discard pile may be reused after shuffling if no winner is present after drawing all of the card deck 20). This process continues for all of the other players at the playing table 12.

The playing continues until a player has a winning hand of one data card 52 and four playing cards 50 of the same value. The winning player then grabs the data spoon 30 on the table thereby indicating to the other players that they have won. The other players then attempt to grab the remaining playing spoons 40. The player who does not grab a playing spoon is the losing player and is given a letter of the word/phrase as shown in FIG. 1 of the drawings. The losing player then retains one of the playing spoons 40 and one of the data cards 52 since there will be one less player. This process continues until a player has spelled the word/phrase (e.g. PRIDE). The player to the left of the prior dealer then is appointed the dealer for the next round. The first player removed is then made the referee of the game as shown in FIG. 1 of the drawings. The remaining players continue playing until all of the players are removed except for one. The remaining player (the ultimate winner) then preferably retains the data spoon 30 which is a potential collectors item.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An interactive game system, comprising:

a card deck comprised of a plurality of playing cards and at least one data card, wherein said card deck is utilized to deal cards to a plurality of players;

wherein said card deck is comprised of a conventional 52 deck of cards;

wherein the number of data cards is calculated from the number of said players minus one; and a set of spoons comprised of a plurality of playing spoons and a data spoon, wherein said data spoon is removed by a winning player with the remaining players attempting to grab said playing spoons, wherein said winning player is identified as a player having a winning hand comprised of one data card and four playing cards of identical value.

2. The interactive game system of claim 1, wherein said data spoon has a subject attached thereto.

3. The interactive game system of claim 1, wherein said at least one data card includes information relating to a subject.

4. The interactive game system of claim 1, including a winning hand comprised of one data card and four playing cards of identical value.

5. The interactive game system of claim 1, wherein said playing cards are comprised of conventional cards.

6. A method of playing a game, comprising:

providing a plurality of players;

providing a card deck comprised of a plurality of playing cards and at least one data card, wherein the number of data cards is calculated from the number of said players minus one;

providing a set of spoons comprised of a plurality of playing spoons and a data spoon, wherein the number of playing spoons is calculated from the number of said players minus two;

positioning said set of spoons upon a playing surface;

dealing a card hand from said card deck to each of said players; and grasping said data spoon by a player with a winning hand wherein the remaining players grasp said playing spoons, wherein said winning hand is comprised of one data card and four playing cards of identical value;

identifying the player without a playing spoon in their possession as the losing player;

giving said losing player a letter of a playing word;

removing said losing player if said letter is comprised of a last letter in said playing word; and removing one playing spoon and one data card from play.

7. The method of playing a game of claim 6, including the step of determining if only one remaining player remains and if so identifying said remaining player as a winning player.

8. The method of playing a game of claim 6, wherein the number of said at least one data cards is calculated from the number of said players minus one.

9. The method of playing a game of claim 6, wherein said data spoon has a subject attached thereto.

10. The method of playing a game of claim 6, wherein said at least one data card includes information relating to a subject.

11. The method of playing a game of claim 6, wherein said playing cards are comprised of conventional cards.

12. The method of playing a game of claim 6, wherein said at least one data card includes state information relating to a specific state.

13. The method of playing a game of claim 12, wherein said state information is selected from a group comprising population, state shape, and state flag.

14. The method of playing a game of claim 6, including the steps of drawing a card from said card deck and discarding a card from a player's hand to a discard pile.

15. A method of playing a game, comprising:

providing a plurality of players;

providing a card deck comprised of a plurality of playing cards and at least one data card;

providing a set of spoons comprised of a plurality of playing spoons and a data spoon, wherein the number of playing spoons is calculated from the number of said players minus two;

(a) positioning said set of spoons upon a playing surface;

(b) dealing a card hand from said card deck to each of said players;

(c) drawing a card from said card deck by a first player;

(d) discarding a first card from a first hand of said first player into a first discard pile;

(e) drawing said first card from said first discard pile by a second player adjacent to said first player;

(f) discarding a second card from a second hand of said second player into a second discard pile;

(g) repeating steps (c) through (f) until a winning player receives a winning hand, wherein said winning hand is comprised of one data card and four playing cards; and (h) grasping said data spoon by said winning player wherein all remaining players grasp any remaining of said playing spoons, wherein a player without a playing spoon is identified as a losing player.

* * * * *